United States Patent [19]

Lash et al.

[11] Patent Number: 4,685,367

[45] Date of Patent: Aug. 11, 1987

[54] TWO CYCLE AIR CUT-OFF PRESS

[75] Inventors: Edward G. Lash, Huntington Woods; Roger Levy, Oak Park; Everett Gleason, South Lyon, all of Mich.

[73] Assignee: Tishken Products Co., Detroit, Mich.

[21] Appl. No.: 826,457

[22] Filed: Feb. 5, 1986

Related U.S. Application Data

[63] Continuation-in-part of Ser. No. 647,042, Sep. 4, 1984, Pat. No. 4,579,031.

[51] Int. Cl.[4] ..... B26D 5/12; B26D 5/18

[52] U.S. Cl. ..... 83/626; 83/630; 83/639; 100/272

[58] Field of Search ..... 83/630, 639, 616, 640, 83/624, 626; 100/271, 272, 273, 281

[56] References Cited

U.S. PATENT DOCUMENTS

| | | | |
|---|---|---|---|
| 1,007,792 | 10/1910 | Orton | 83/630 |
| 1,749,545 | 1/1928 | Pierce | 83/630 |
| 1,918,059 | 6/1929 | Sherman | 83/630 |
| 2,087,811 | 6/1934 | Patrick | 100/272 |
| 2,441,275 | 10/1944 | Keagle | 100/271 |
| 3,183,743 | 5/1965 | O'Donnell | 83/630 |
| 3,691,890 | 9/1972 | Kuchyt | 83/624 |
| 4,172,401 | 10/1979 | Albareda | 83/630 |

FOREIGN PATENT DOCUMENTS

| | | | |
|---|---|---|---|
| 1387049 | 12/1964 | France | 100/272 |

*Primary Examiner*—E. R. Kazenske
*Assistant Examiner*—Scott A. Smith
*Attorney, Agent, or Firm*—Cullen, Sloman, Cantor, Grauer, Scott & Rutherford

[57] ABSTRACT

The present invention relates to a power assembly and fluid supply system for use in a two cycle air cut-off press. The power assembly includes a bell crank having first and second arms extending outwardly at an angle from a fulcrum with the bell crank being pivotally mounted opposite the fulcrum. The arms have rollers connected to them and are positioned beneath guide bars which are alternately reciprocated by power cylinders. Due to the rollers, there are no lateral forces, reducing wear. A link interconnects the bell crank with the ram plate of the press. As the bell crank oscillates about its pivotal mount, the link transfers the oscillatory movement to the ram plate as reciprocal movement. The fluid supply system of the present invention includes an adjustable three-way valve connected to a source of pressurized fluid. In a first position, the valve communicates pressurized fluid to one power cylinder while the other power cylinder is exhausted and in a second position communicates pressurized fluid to the other cylinder while the first cylinder is exhausted.

14 Claims, 3 Drawing Figures

TWO CYCLE AIR CUT-OFF PRESS

This is a continuation-in-part of U.S. patent application Ser. No. 647,042 filed Sept. 4, 1984 now U.S. Pat. No. 4,579,031, issued Apr. 1, 1986.

BACKGROUND OF THE INVENTION

The present invention relates to a two cycle air cut-off press having a stationary bed plate and a ram plate defining a die set area. An upper movable die set is connected to the ram plate and a lower stationary die set is connected to the bed plate. With such a construction, the lower die set is adapted to receive and intermittently cut off or otherwise impinge upon a transversely movable work piece or stock which is engagable with the upper die set.

THE PRIOR ART

Illustrative of the prior art is U.S. Pat. No. 3,545,368, dated Dec. 8, 1970, of Robert Paul Lickliter et al. showing a pneumatic press with a cylinder reciprocated ram plate.

U.S. Pat. No. 2,156,323, dated May 2, 1939, of Paul Tishken is illustrative of a modified cut-off press wherein the power means affects reciprocal movements of the plurality of draw rods for affecting corresponding reciprocal movements of a ram plate or head.

BRIEF SUMMARY OF THE INVENTION

An important feature of the present invention is to provide a cut-off press or apparatus having an improved power mechanism for reciprocally operating a ram plate with respect to a bed plate. A die set area is provided between the plates. Typically, the die set area includes opposed upper and lower track members for mounting upper and lower die sets respectively. With such a construction, an elongated transversely adjustable work piece is movable over the lower die set and the upper die set is adapted to intermittently act upon and cut off portions of the work piece that passes transversely over the lower die set.

More particularly, the present invention includes a bell crank assembly having first and second arms extending outwardly at an angle from a fulcrum with the bell crank being pivotally mounted opposite the fulcrum. A link means interconnects the bell crank with the ram plate. The link has one end connected at the fulcrum of the bell crank and the opposite end connected to the ram plate. As the bell crank oscillates, the link transfers the oscillatory movement to the ram plate as reciprocal movement.

The arms of the bell crank have rollers connected to them and are positioned beneath guide bars which are reciprocally mounted upon guide posts. The guide bars are alternately reciprocated by power cylindres. Due to the rollers, there are no lateral forces exerted upon the guide posts reducing the wear normally encountered in presses.

The maximum downward force exerted by the ram plate corresponds to the link being substantially vertical midway between its outermost oscillatory positions. The final one-quarter inch of downward stroke provides a working force in the ration of approximately eight to one.

The power cylinders of the present invention are controlled by an adjustable three-way valve. The valve interconnects the cylinders with a source of pressurized fluid and in one position communicates fluid to one cylinder while exhausting the other and in a second position communicates fluid to the other cylinder while exhausting the first cylinder.

The power cylinders are mounted upon a plate that is movable so the press stroke may be adjusted. In the preferred embodiment, the cylinders are mounted on an upper plate parallel to and spaced from the ram plate. The upper plate is supported by removable spacers which can be individually removed to adjust the height of the plate and the press stroke. In addition, the speed of the press can be controlled by a flow control in the cylinder fluid circuit.

In the preferred embodiment, the ram plate is spring biased to the top of its reciprocal movement so that the die head is automatically returned to the top position. This is beneficial in the event of power failure.

These and other features and objects will be seen from the following specification and claims in conjunction with the appended drawings.

DETAILED DESCRIPTION OF THE INVENTION

Figure 1:
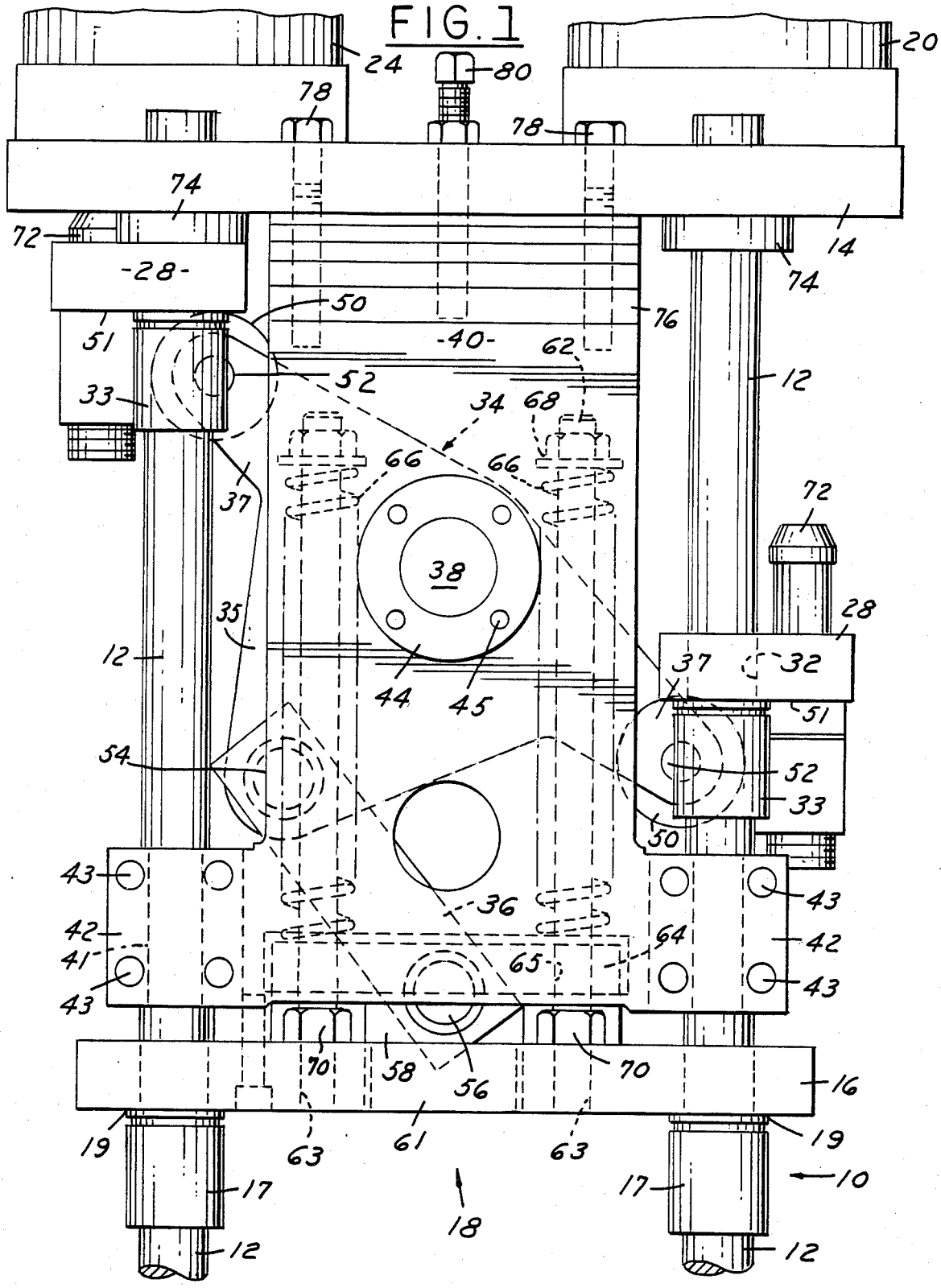
FIG. 1 is a fragmentary front elevational view of the present two cycle air cut-off press.

With reference to FIG. 1, the two cycle air cut-off press of the present invention is shown generally at 10 and includes a base (which is not illustrated) to which spaced upright guide posts 12 are mounted. An apertured top plate 14 is positioned at the opposite ends of posts 12 and a ram plate 16 having spaced apertures 19 is reciprocally received by posts 12. The area below ram plate 16 and above the bottom plate forms a die set area 18. A plurality of guide bushings 17 depend from ram plate 16 in registry with apertures 19 to facilitate reciprocal movement.

Figure 2:
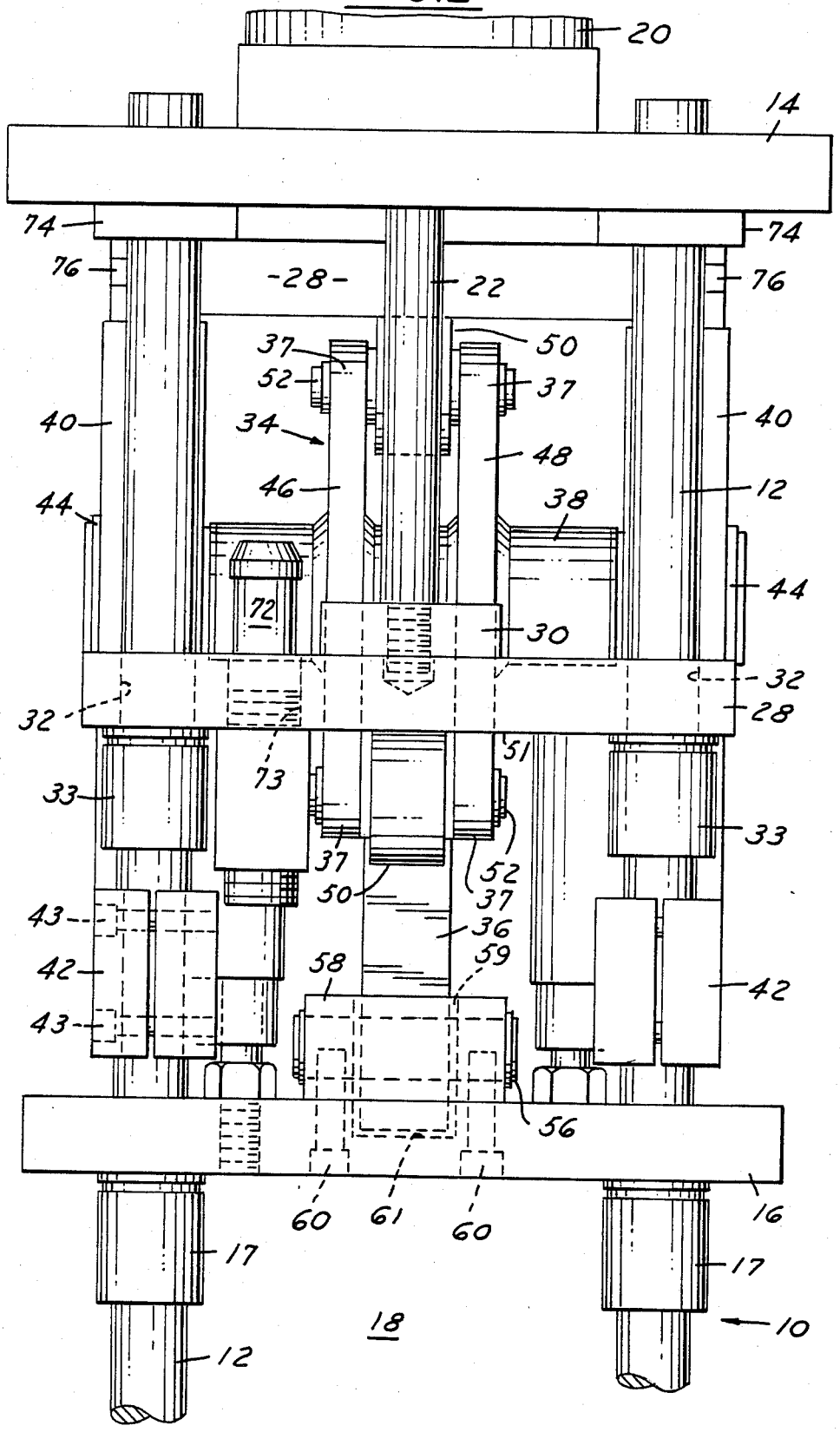
FIG. 2 is a fragmentary side elevational view of the cut-off press of FIG. 1.
Figure 3:
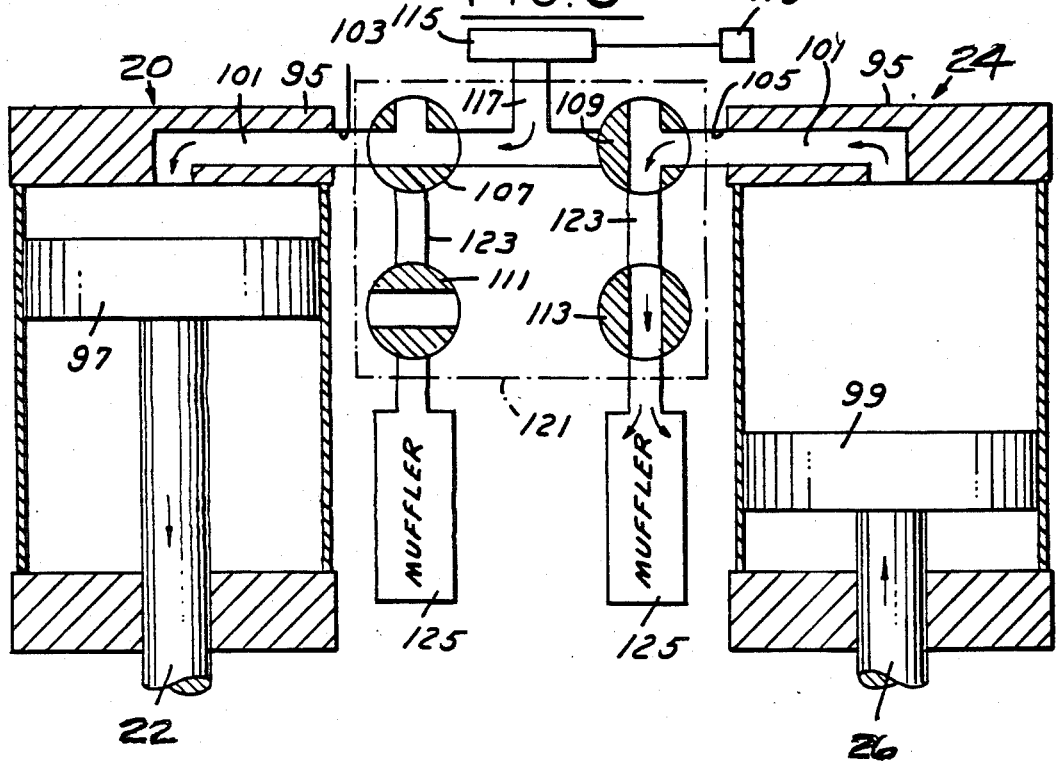
FIG. 3 is a fragmentary, schematic and sectioned view of the pneumatic circuit and control valve assembly for the present invention.

With reference to FIGS. 2 and 3, a first air cylinder 20 having a depending piston rod 22 and a second air cylinder 24 having a depending piston rod 26 are mounted on top plate 14 to provide the alternating force necessary to reciprocate ram plate 16. Each piston rod 22 and 26 is mounted to a guide block 28 having spaced apertures 32 reciprocally received by guide posts 12. Bushings 33 are received by apertures 32 to facilitate the reciprocal movement of blocks 28. To facilitate mounting, rod end blocks 30 are first attached to rods 22 and 26 respectively and then attached to blocks 28 by, as for example, machine bolts or welding.

Operatively connected between blocks 28 is a bell crank assembly 34 which has a fulcrum 35 at the apex of the angle formed by arms 37. Crank assembly 34 is mounted opposite fulcrum 35 on a lateral shaft 38 extending between two spaced fixed support plates 40. Each support plate 40 has clamps 42 at its base which are received within machined sections 41 on posts 12 and fastened by, as for example, machine bolts 43. To facilitate movement of crank assembly 34, annular bearings 44 are provided and fastened to plate 40 by, as for example, bolts 45.

In the preferred embodiment, crank assembly 34 has a first bell crank member 46 and a laterally spaced second bell crank member 48. See FIG. 2. Rollers 50 are mounted between the arms 37 of crank members 46 and 48 and are held in place by axle pins 52. Rollers 50 operatively contact blocks 28 such that as rods 22 and 26 are alternately extended and retracted, crank assembly 34 oscillates and rollers 50 roll along the undersurface 51 of blocks 28. This rolling action eliminates any lateral forces which would be encountered at posts 12 if the connection between crank assembly 34 and blocks 28 were fixed. The elimination of lateral forces reduces wear in posts 12, bushings 33, blocks 28 and bearings 44 and reduces operating noises.

The oscillatory movement of crank assembly 34 caused by guide blocks 28 is communicated to ram plate 16 by a link means 36. Link 36 is pivotally connected at one end to the fulcrum 35 of crank 34 by a pin 54 and at its opposite end to ram plate 16 by a pin 56. In the preferred embodiment, an anchor block 58 having an aperture 59 in communication with a like aperture 61 in plate 16 pivotally receives link 36. Anchor block 58 is fastened to plate 16 by, as for example, bolts 60.

In operation, as blocks 28 alternately reciprocate along posts 12, crank assembly 34 is oscillated about shaft 38 and link 36 translates the oscillatory movement to plate 16 as reciprocal movement. Link 36 pivots between outermost positions with respect to a vertical center line intersecting shaft 38 and pin 56. At the outermost extremes, plate 16 is at its uppermost position. When link 36 is colinear with the vertical center line, plate 16 is at its downwardmost position corresponding to the greatest amount of applied force. For illustration, the last one-quarter inch of downward stroke of plate 16 provides a working force in the ratio of approxiamtely eight to one. Link 36 and crank 34 provide a multiplier factor to the reciprocal movements of rods 22 and 26.

As should be apparent, each complete extension of rod 22 or 26 corresponds to one complete cycle of ram plate 16. As for example, as piston rod 22 fully extends to its lowermost position, link 36 first pivots from an outermost position to a colinear position which corresponds to ram plate 16 moving from its uppermost to its lowermost position and then link 36 pivots from the colinear position to the opposite outermost position which corresponds to ram plate 16 moving from its lowermost to its uppermost position. During this operation, rod 26 has been forced by crank assembly 34 to its uppermost position and is now ready to descend to its lowermost position to complete another cycle of ram plate 16.

In the event that cylinders 20 and 24 are inoperative, ram plate 16 is automatically biased by biasing means to the uppermost position. In the preferred embodiment, the biasing means includes a spring bracket 64 having spaced apertures 65 which reciprocally receive spaced guide rods 62. Bracket 64 is attached to support plate 40 by, as for example bolts and rods 62 are mounted within bore 63 in ram plate 16. Coil springs 66 are received about rods 62 and are retained between spring bracket 64 and a retaining means 68, such as a nut and washer. As ram plate 16 is forced to its lowemost position, it is simultaneously urged to its uppermost position by the compression of springs 66 between retaining means 68 and spring bracket 64. Therefore, if the press should lose power, spring 66 will urge plate 16 to the uppermost position. An adjustment nut 70 is provided to adjust spring 66.

To absorb the return of guide blocks 28, shock absorbers 72 are mounted within bores 73 in clocks 28. As blocks 28 return to their uppermost positions, shock absorbers 72 contact plate 14 and absorb the upward force. In the preferred embodiment, resilient pads 74 are also provided to additionally absorb the force of blocks 28.

The stroke of pistons 20 and 24 can be adjusted by removable spacer plates 76 which are positioned between top plate 14 and the top surface of plate 40. In the preferred embodiment, plates 76 are retained in position by bolts 78. To adjust the stroke, bolts 78 are first loosened and positive pressure bolt 80 is tightened against the upper surface of plate 40 to raise top plate 14. After top plate 14 has been raised, spacers 76 can be individually removed until the proper stroke is obtained.

There is schematically shown in FIG. 3 a pneumatic diagram for controlling the intermittent alternate operation of cylinder assemblies 20 and 24. Each of the cylinders have common intake and exhaust passages 101 which connect with conduits 103 and 105 in valve housing 121. Within valve housing 121, there are provided a pair of normally non-energized control valves 107 and 109. In FIG. 3, the first valve 107 has been energized to an open position and the second valve 109 is in a non-energized condition. Normally closed two way valve 111 is positioned within the valve housing 121 blocking off the flow of exhaust fluid through one of the exhaust conduits 123 through the connected muffler 125.

The normally closed two way valve 113 is positioned within valve housing 121 and normally blocks off the flow of exhaust through a second exhaust conduit 123 and connected muffler 125. As schematically shown in FIG. 3, fluid reservoir or accumulator tank 115 has a compressed fluid outlet 117 which communicates with conduits 103 and 105 under the control for the normally closed three way valves 107 and 109.

Reservoir 115 is connected to a suitable source of compressed fluid, such as air, at 119. The positioning of the respective valves 107 and 109 alternately controls the flow of pressurized air through one or the other of the passages 101, as for example to cylinder 20, FIG. 3, for pressurizing piston 97 to extend piston rod 22.

For this purpose, valve 107 has been automatically moved to the open position shown so that pressurized air from reservoir 115 can flow through valve 107, through passage 103 and conduit 101 into the upper end of cylinder 20. At the same time, the second control valve 109 is non-energized and remains in such position so that as the piston 99 in the second cylinder 24 retracts under the action of the bell crank assembly 34, the exhaust air therein moves outwardly as shown by the arrows. Exhaust air passes through exhaust passage 101 and conduit 105, through the valve 109 through exhaust passage 123, through the open valve 113 and through muffler 125 to atmosphere.

For an explanation of the operation of the respective valves 107, 109, 111 and 113 at the beginning of the stroke of piston 97, there is the following working condition:

1. Valve 107 is energized and open.
2. Valve 109 is not energized and closed.
3. Valve 111 is not energized and closed.
4. Valve 113 is energized and open.

At about the middle of the downward stroke of piston 97, FIG. 3, the following condition exists:

1. Valve 107 is not energized and closed.
2. Valve 109 is not energized and closed.
3. Valve 111 is not energized and closed.
4. Valve 113 is energized and open.

Exhaust air from the upper end of cylinder 24 under the force of the retracting piston 99 flows through the combination exhaust and intake passages 101, 105, through the open valve 109, through the open exhaust valve 113 and through muffler 125 to atmosphere.

For effecting a stop of the piston 97 in anticipation of the application of pressurized air to the piston 99 of the second cylinder assembly 24 and with the stroke of piston 97 being 75% complete, the valves are not energized, with the result that flow of pressurized air to cylinder 20 is blocked as is the exhaust from the cylinder assembly 24.

With valve 111 also not energized, both of the exhaust conduits 123 are blocked with the result that there is a mechanical stopping of the movement of both pistons 97 and 99.

For the beginning of the stroke working portion for the second cylinder assembly 24, the following valve conditions exist:

1. Valve 107 is not energized and closed.
2. Valve 109 is energized and open.
3. Valve 111 is energized and open.
4. Valve 113 is not energized and closed.

By this construction, the pressurized air at 117 passes through valve 109, through the passages 105 and 101 into the upper end of cylinder 24 causing piston 99 and the connected piston rod 26 to advance downwardly. At the same time, the bell crank assembly 34 causes upward movement of piston rod 22 and piston 97 so that exhaust air above piston 97 moves through passages 101 and 103, through the valve 107, through the open exhaust valve 111 and through muffler 125 to atmosphere. As an intermediate condition, the valve conditions are as follows:

1. Valve 107 is not energized and closed.
2. Valve 109 is not energized and closed.
3. Valve 111 is not energized and open.
4. Valve 113 is not energized and closed.

This cuts off the flow of pressurized air to the upper end of cylinder 24 and piston 99. However, the exhaust from cylinder 20 is free to pass through the non-energized valve 107 and through the open exhaust valve 111 to atmosphere.

With the stroke of piston 99, 75% complete, no valves are energized. Air is trapped in both cylinders 20, 24 to cause an immediate stop of the respective pistons therein and connected bell crank assembly 34.

This succession of operation of the corresponding valves may be controlled automatically by (a) suitable valve controls connected to the respective valves for operation in the desired time sequence and (b) suitable switching mechanism for automatically operating the valves in the above sequence.

In operation, the advancing of one piston rod rotates the bell crank assembly 34 in one direction, with the bell crank assembly retracting the other piston rod. The air in the corresponding cylinder escapes through the exhaust passage 101 and through one of the exhaust conduits 123, FIG. 3.

More broadly defined in connection with the cylinders 20 and 24, there is provided an adjustable three-way valve means embodied in the pair of valves 107 and 109 which are connected to a source of pressurized air at 115, 117, 119. Pressurized air passes through conduits 101 alternately communicating pressurized air to one cylinder, with the other cylinder exhausting to atmosphere. When the corresponding valve means 107–109 is moved to a second position, pressurized air is connected to the second cylinder 59 with the first cylinder 20 exhausting to atmosphere.

Whatever cylinder is pressurized, the other cylinder is delivering the exhaust through the corresponding passage 101, through one or the other of the exhaust passages 103, through the open exhaust control valve 111 or 113 and through the corresponding muffler 125. The primary purpose of the mufflers 125 on the exhaust conduits is to reduce the noise level of the exhaust air passing therethrough, in compliance with Federal regulations.

The speed of ram 16 can also be adjusted by controlling the flow of fluid in the fluid circuit above-described.

It will be apparent to those skilled in the art that the foregoing disclosure is exemplary in nature rather than limiting, the invention being limited only by the appended claims.

What is claimed is:

1. A power means for use in a two cycle air cut-off press, said press having a stationary bed plate, spaced upright guide posts mounted upon the bed plate, a top plate received over the opposite ends of said guide posts and an apertured ram plate guidably received and reciprocally mounted upon said guide posts defining with the bed plate a die set area;

said power means comprising:

first and second cylinder means mounted on said top plate including depending first and second piston rods;

first and second opposed guide blocks reciprocally mounted upon said guide posts and connected to said first and second piston rods respectively, said guide blocks freely reciprocating between upper and lower positions along said guide posts in response to reciprocal movement of said piston rods;

a crank assembly having first and second arms extending outwardly at an angle from a fulcrum, said assembly being pivotally mounted opposite said fulcrum to oscillate about a transverse axis with each of said arms operatively engaging said guide blocks such that reciprocal movement of said guide blocks oscillates said assembly about said transverse axis;

a link means interconnecting said assembly and said ram plate, said link means having one end pivotally connected to said ram plate with said opposite end pivotally connected to said assembly at said fulcrum;

whereby alternate reciprocal movements of said piston rods affect oscillatory movement of said assembly which affects combined oscillatory reciprocal movement of said link and reciprocal movement of said ram plate.

2. The power means of claim 1, wherein said link means oscillates between outermost positions upon opposite sides of said transverse axis;

the maximum downward force being exerted by said link means upon said ram plate corresponding to said link means being substantially vertical midway between said outermost positions.

3. The power means of claim 1, wherein the final one-quarter inch of downward stroke of said ram plate provides a working force in the ratio of approximately eight to one.

4. The power means of claim 1, wherein said assembly includes first and second bell cranks spaced along said transverse axis with said link means pivotally connected between said spaced bell cranks.

5. The power means of claim 1, wherein said operative engagement between said arms and said guide blocks includes rollers mounted upon each of said first and second arms;

said rollers contacting and following said guide blocks, therein eliminating lateral forces in said guide posts during reciprocal movement.

6. The power means of claim 1, wherein said upper plate includes adjustment means to adjust the stroke of said first and second cylinder means.

7. The power means of claim 6, wherein said adjustment means includes a series of removable spacer plates supporting said upper plate.

8. The power means of claim 1, further comprising biasing means to urge said ram plate upwardly toward said upper plate, whereby said ram plate is automatically returned to a spaced position from said bed plate when said cylinder means are inoperative.

9. The power means of claim 1, further comprising shock absorbers operatively mounted upon said guide blocks to absorb impact as said guide blocks approach said upper position.

10. The power means of claim 1, said cylinder means including first and second cylinders and pistons therein, each cylinder having a common intake and exhaust port;

a valve housing having an inlet for receiving pressurized fluid from a source;

a pair of pressure conduits in said valve housing connected to said cylinder ports;

first and second normally closed three-way alternately actuated control valves in said valve housing for delivering pressurized fluid from one valve to one of said pressure conduits to one cylinder for advancing the piston therein; and a pair of exhaust conduits in said valve housing connected to each of said valves, the other cylinder pressure conduit being connected by the other valve to one of said exhaust conduits;

the advancing of said one piston rod rotating said assembly in one direction, said assembly retracting the other piston rod, the fluid in the corresponding cylinder escaping through its exhaust port and through one of said exhaust conduits.

11. The power means of claim 1, said cylinder means including the first and second cylinders with pistons therein;

an adjustable three way valve means connected to a source of pressurized fluid and including a pair of pressure conduits connected to each cylinder;

said valve means in one position communicating pressurized fluid to one cylinder, the other cylinder exhausting; and said valve means when moved to a second position communicating pressurized fluid to the other cylinder, the first cylinder exhausting.

12. The power means of claim 10, further comprising a two-way exhaust control valve within each exhaust conduit movable between open and closed positions, and when open permitting flow of exhaust fluid through the corresponding exhaust conduit.

13. The power means of claim 12, wherein said exhaust valves when closed stop movement of said ram plate.

14. The power means of claim 12, further comprising a muffler on each exhaust conduit to reduce the noise level of exhaust fluid passing therethrough.

* * * * *